US009314119B2

(12) United States Patent
Parker et al.

(10) Patent No.: US 9,314,119 B2
(45) Date of Patent: Apr. 19, 2016

(54) NOODLE BEVERAGE CONTAINER

(71) Applicants: Timothy Scott Parker, Griffin, GA (US); Greg Neely, Zebulon, GA (US); Cameron Paul Parker, Palmetto, GA (US)

(72) Inventors: Timothy Scott Parker, Griffin, GA (US); Greg Neely, Zebulon, GA (US); Cameron Paul Parker, Palmetto, GA (US)

(73) Assignee: MATADOR MANAGEMENT LTD., Mission (CA)

( * ) Notice: Subject to any disclaimer, the term of this patent is extended or adjusted under 35 U.S.C. 154(b) by 0 days.

(21) Appl. No.: 14/249,118

(22) Filed: Apr. 9, 2014

(65) Prior Publication Data

US 2015/0289690 A1 Oct. 15, 2015

(51) Int. Cl.

| | |
|---|---|
| ***A47G 19/22*** | (2006.01) |
| ***A45F 3/20*** | (2006.01) |
| *A45F 3/16* | (2006.01) |

(52) U.S. Cl.

CPC ..... *A47G 19/2205* (2013.01); *A45F 3/16* (2013.01); *A45F 3/20* (2013.01); *A45F 2003/166* (2013.01); *A47G 2200/02* (2013.01)

(58) Field of Classification Search

CPC ..... B65D 23/12; B65D 23/14; B65D 43/02; C02F 1/005; C02F 1/482; C02F 2307/02; A47G 19/2205; A47G 2200/02

USPC ..... 220/560; 446/153; 472/129; 441/129

See application file for complete search history.

(56) References Cited

U.S. PATENT DOCUMENTS

| | | | | |
|---|---|---|---|---|
| 7,052,347 | B2 | 5/2006 | Goldmeier | |
| 2008/0121652 | A1 * | 5/2008 | Orlowski et al. | 222/79 |

* cited by examiner

*Primary Examiner* — Fenn Mathew
*Assistant Examiner* — Elizabeth Volz

(57) ABSTRACT

A beverage container within a floatation device, such as a noodle, is provided. The beverage container may include a flexible tubular body made of a food grade polymer. The beverage container includes a first end and a second end. At least one of the first end and the second end includes a nozzle that delivers beverages within the beverage container. The beverage container may fit within a hollow center of the floatation device. The nozzle may protrude outside of the floatation device. Therefore, a user may float in water and drink from the beverage container without spilling the beverage.

14 Claims, 3 Drawing Sheets

NOODLE BEVERAGE CONTAINER

BACKGROUND OF THE INVENTION

The present invention relates to a beverage container and, more particularly, to a beverage container within a noodle Enjoying a beverage in a pool, ocean, lake or other body of water is challenging. The individual risks spilling the beverage and wasting it or contaminating the water in a pool. Currently, to attempt at coping with the situation, a cup holder may be placed within a noodle. However, the drink may still easily spill from the cup holder.

As can be seen, there is a need for an improved device that secures a beverage and provides floatation.

SUMMARY OF THE INVENTION

In one aspect of the present invention, an apparatus comprises: a floatation device comprising a tubular body having at least a partially hollow center; and a beverage container comprising a nozzle, wherein the beverage container is at least partially within the hollow center and the nozzle is protruding outside of the floatation device.

In another aspect of the present invention, an apparatus comprises: a beverage container comprising a flexible tubular body sized to fit at least partially within a hollow center of a pool noodle, wherein the beverage container comprises a first end and a second end, wherein at least one of the first end and the second end comprises a nozzle.

In another aspect of the present invention, a method of floating in water with a beverage comprises: providing a beverage container comprising a flexible tubular body having a first end and a second end, wherein at least one of the first end and the second end comprises a nozzle; filling the beverage container with a consumable liquid; placing the beverage container within a hollow center of a pool noodle; and floating in a body of water by way of the pool noodle.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a plastic tube encased in buoyant foam to hold a beverage. This foam noodle float may contain a plastic flexible tube through the center of the entire length of the noodle. There may be a plug at one end and a cap with a straw on the other end. The straw may be capped with a bite valve for easy access and to prevent leaking.

The present invention includes a float with a capped beverage container to prevent spills. The foam that encases the tube may also insulate the tube to keeps beverages cold. The present invention prevents spills, may be used in any position that a normal pool noodle can be used, keeps the beverage cold longer, and allows a user to float completely submerged, if desired, and still be able to drink the beverage.

Figure 1:
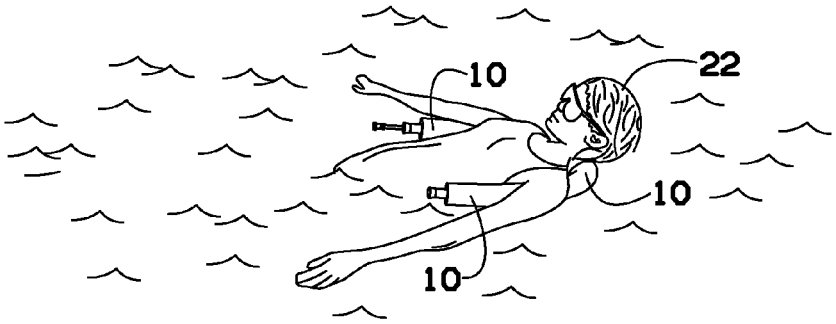
FIG. 1 is a perspective view of the present invention demonstrating usage of a floatation device.
Figure 2:
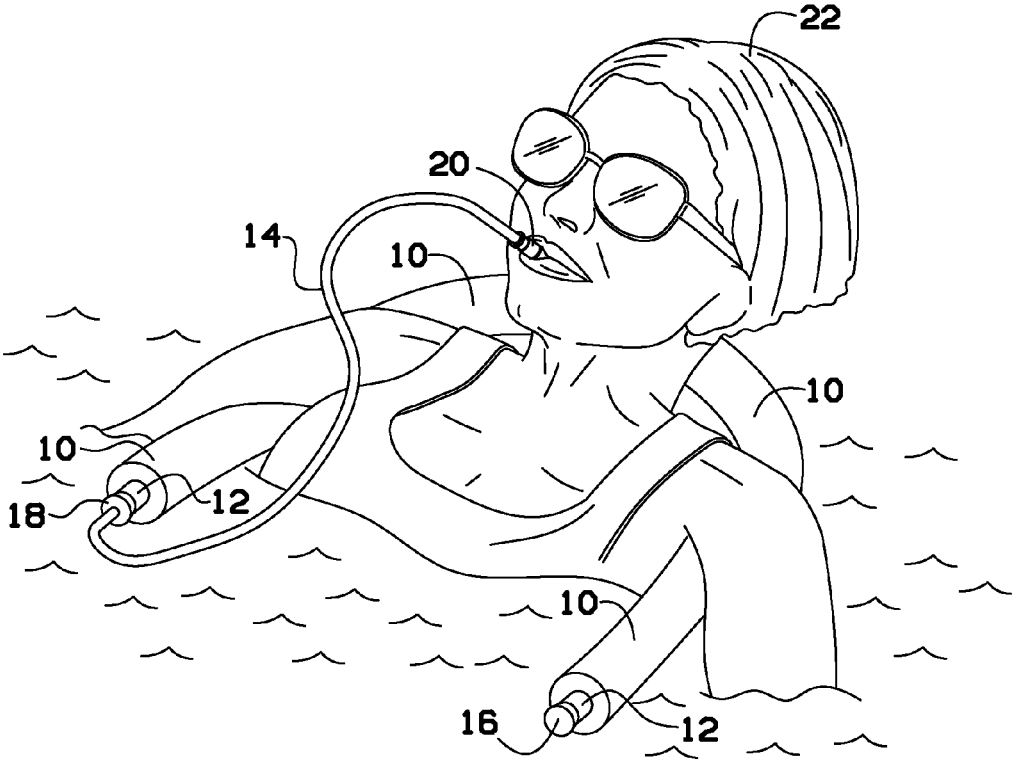
FIG. 2 is a perspective view of the present invention demonstrating usage of a drinking container within the floatation device of FIG. 1.
Figure 3:
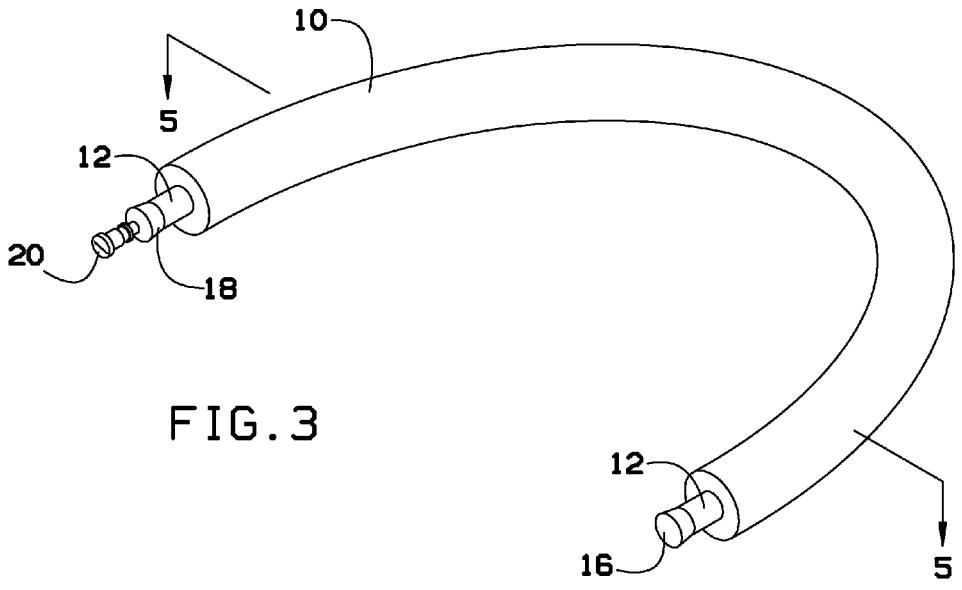
FIG. 3 is a perspective view of the present invention demonstrated with a hose retracted within the drinking container.
Figure 4:
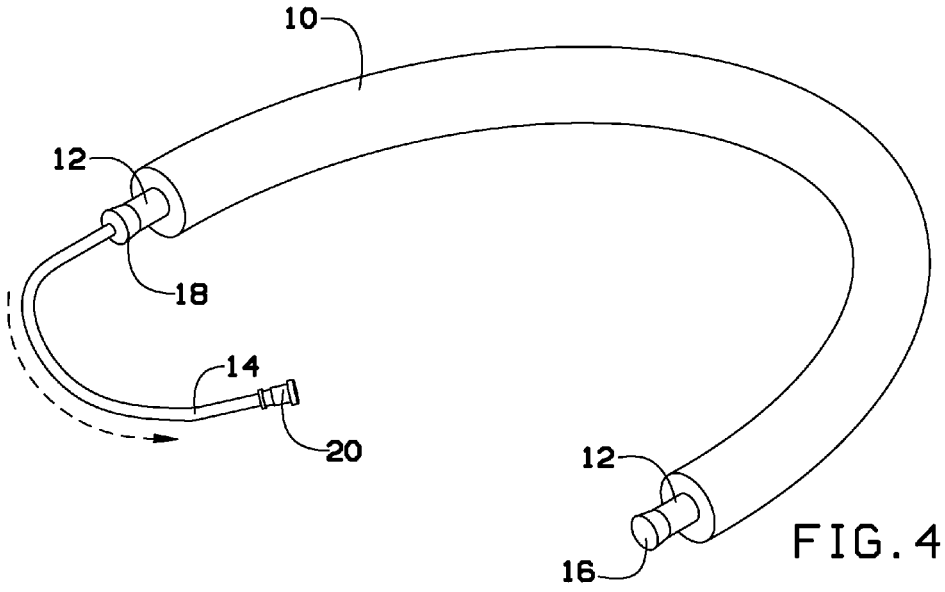
FIG. 4 is a perspective view of the invention demonstrated with the hose of FIG. 3 extended from the drinking container.
Figure 5:
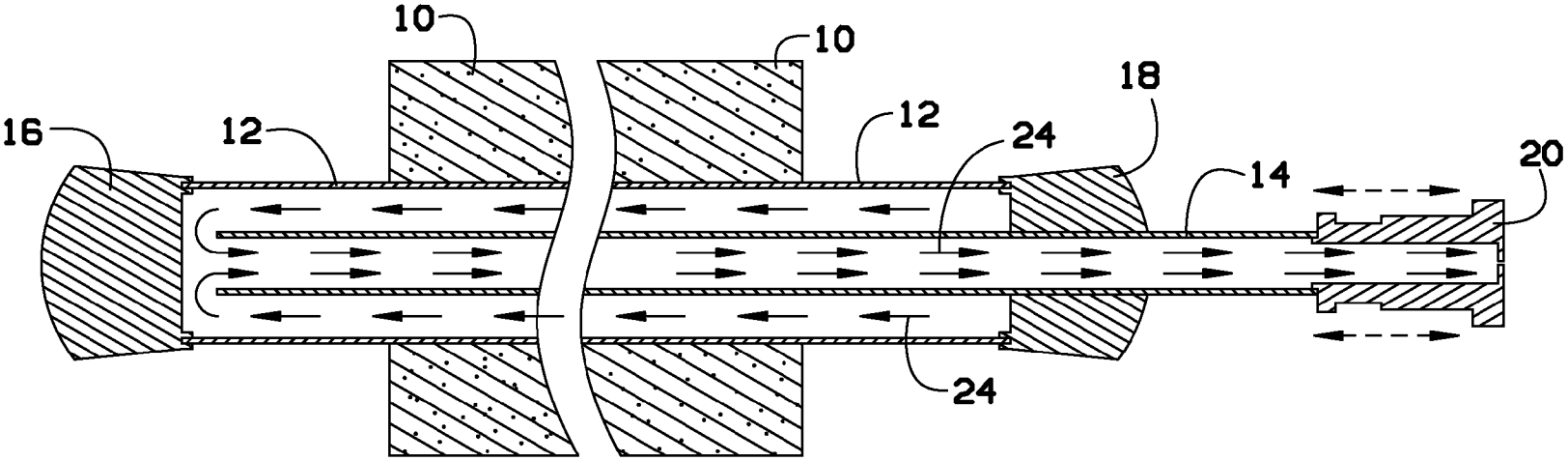
FIG. 5 is a section detail view of the present invention along line 5-5 in FIG. 3.

Referring to FIGS. 1 through 5, the present invention includes a beverage container 12 that includes a flexible tubular body made of a food grade polymer. The beverage container 12 includes a first end and a second end. At least one of the first end and the second end includes a nozzle 20 that delivers beverages 24 within the beverage container 12. The beverage container 12 may fit within a hollow center of a floatation device 10. The nozzle 20 may protrude outside of the floatation device 10. Therefore, the beverage container 12 is sized to fit at least partially within the hollow center of the floatation device 10.

In certain embodiments, the floatation device 10 may include a first end and a second end. The first end and the second end each includes openings leading into the hollow center. The floatation device 10 may include a pool noodle made of insulating foam, such as polyethylene foam. The first end of the beverage container 12 may be disposed at the opening of the first end of the floatation device 10, and the second end of the beverage container 12 may be disposed at the opening of the second end of the floatation device 10. Thereby the beverage container may be within a substantial portion of the hollow center of the floatation device 10.

In certain embodiments, the beverage container 12 may include openings on the first end and the second end. To contain the beverage within the beverage container 12, the present invention may include first cap 18 on the first end of the beverage container 12 and a second cap 16 on the second end of the beverage container 12. In certain embodiments, the first cap 18 and the second cap 16 may be removable to fill the beverage container 12 with a beverage 24. Further, a funnel may be used with or incorporated into one of the ends of the beverage container 12 for filling the beverage container 12 with ease.

The present invention may further include an extendable hose 14 having the nozzle 20. The nozzle 20 may include a valve to control the flow of beverage 24 from the nozzle 20. For example, the valve may be a bite valve. However, the present invention is not limited to a bite valve, and may utilize other valves or covers. In certain embodiments, at least one of the first cap 18 and the second cap 16 may include an aperture running through. The extendable hose 14 may run through the aperture and into the beverage container 12 and may be freely pulled through the aperture. The extendable hose 14 may include a stopper at the opposite end of the nozzle 20 to prevent the hose 14 from being pulled out completely from of the beverage container 12.

In certain embodiments, the tubular body of the beverage container 12 may run through the entire length of the foam. The second cap 16 may be inserted into one open end of the beverage container 12 to prevent the liquid from coming out the other side. The first cap 18 holds the extendable hose 14 and caps the open end of the tubular body snugly to prevent any liquid from escaping. The extendable hose 14 extends out of the tubular body and is fitted with a hydration bite valve. Therefore, the user 22 may drink from the beverage container 12 hands free without liquid escaping through the hose 14 when not in use.

A method of using the present invention may include the following. Remove the cap and hose assembly and pour a liquid into the primary tube with the beverage of your choice either directly, or by using a funnel for assistance. Replace the hose and cap by running the extendable hose down the tubular body in the beverage and fixing the cap to the end of the tubular body. The float is now ready to be used as a noodle float with no limitations as to position of use.

A method of making the present invention may include the following. The clear flexible tubing is inserted in the hole of the PE foam noodle through the entire length of the foam noodle. A round cap is placed in one end of the tube to block the end of the tube. A round cap with a hole in the center is fitted over the other end of the tube. This cap may be removable. The cap could also be permanent still allowing liquid to be poured into the tube without removing the cap. A smaller diameter hose is inserted through the end cap via the hole in the center. The hose may span any length of the primary tube. A bite valve is fixed to the exposed end of the hose. These components may be assembled in any order to result in the finished product.

Various bite valves, nipples or caps may be used on the end of the hose to draw liquid out of the primary tube. The size of the noodle and tubing can vary to accommodate different liquid holding capacities. In the same instance different size plugs and caps would be used to properly fit the different sized tube. Different lengths of hoses may be used as well. The color of all elements may vary to add variety. Alternative to the caps, the primary tube may be sealed via a clip, a putty or other stopping device or if the tube were manufactured with a closed end.

The noodle of the present invention may be used as an exercise device that will provide the needed hydration within the noodle as well as adding weight variation to the noodle itself. It could also be used as an attachment to other floats with the application of clips, Velcro or some other device to attach the noodle to another float. It could also be clipped together with other noodle floats creating a network of floats.

It should be understood, of course, that the foregoing relates to exemplary embodiments of the invention and that modifications may be made without departing from the spirit and scope of the invention as set forth in the following claims.

What is claimed is:

1. An apparatus comprising:

a floatation device comprising a tubular body having at least a partially hollow center; and a beverage container comprising a flexible tubular body having a nozzle comprising at least one of a cover and a valve covering an opening formed through the nozzle, wherein the beverage container is at least partially within the hollow center and the nozzle is protruding outside of the floatation device.

2. The apparatus of claim 1, wherein the nozzle comprises a bite valve.

3. The apparatus of claim 1, wherein the floatation device is a pool noodle.

4. The apparatus of claim 1, wherein the floatation device comprises a first end and a second end, wherein the first end and the second end each comprise openings leading into the hollow center.

5. The apparatus of claim 4, wherein the beverage container comprises a first end and a second end, wherein the first end of the beverage container is disposed at the opening of the first end of the floatation device, and the second end of the beverage container is disposed at the opening of the second end of the floatation device, thereby the beverage container is within a substantial portion of the hollow center of the floatation device.

6. The apparatus of claim 5, wherein the beverage container comprises a first cap on the first end of the beverage container and a second cap on the second end of the beverage container.

7. The apparatus of claim 6, wherein at least one the first cap and the second cap is removable.

8. The apparatus of claim 6, wherein the flexible tubular body further comprises an extendable hose comprising the nozzle, wherein at least one of the first cap and the second cap comprises an aperture running through, wherein the extendable hose runs through the aperture and into the beverage container.

9. An apparatus comprising:

a beverage container comprising a flexible tubular body having a first end and a second end, and sized to fit at least partially within a hollow center of a pool noodle;

at least one cap secured to one of the first end and the second end of the beverage container; and an extendable hose comprising a nozzle, wherein the extendable hose runs through an aperture formed through the at least one cap and into the beverage container.

10. The apparatus of claim 9, wherein the beverage container is sized to fit substantially within the hollow center of the pool noodle.

11. The apparatus of claim 9, wherein the at least one cap comprises a first cap on the first end of the beverage container and a second cap on the second end of the beverage container.

12. The apparatus of claim 11, wherein at least one of the first cap and the second cap is removable.

13. The apparatus of claim 9, wherein the nozzle comprises a bite valve.

14. A method of floating in water with a beverage comprising:

providing a beverage container comprising a flexible tubular body having a first end and a second end, wherein at least one of the first end and the second end comprises a nozzle comprising at least one of a cover and a valve covering an opening formed through the nozzle;

filling the beverage container with a consumable liquid;

placing the beverage container within a hollow center of a pool noodle; and floating in a body of water by way of the pool noodle.

* * * * *